United States Patent [19]

Barker et al.

[11] Patent Number: 4,759,291

[45] Date of Patent: Jul. 26, 1988

[54] THROUGH BULKHEAD EXPLOSIVE INITIATOR FOR OIL WELL USAGE

[75] Inventors: James M. Barker, Katy; Larry L. Grigar, East Bernard; Dennis E. Schramek, Houston, all of Tex.

[73] Assignee: Halliburton Company, Duncan, Okla.

[21] Appl. No.: 69,741

[22] Filed: Jul. 6, 1987

[51] Int. Cl.[4] ..... F42C 19/12; F42B 19/08; F42D 1/04

[52] U.S. Cl. ..... 102/202.5; 102/275.5; 102/275.6

[58] Field of Search ..... 102/275.1–275.7, 102/275.9, 275.11, 275.12, 202.5, 322, 202.4

[56] References Cited

U.S. PATENT DOCUMENTS

| | | | |
|---|---|---|---|
| 2,889,773 | 6/1959 | Staadt et al. | 102/275.5 X |
| 3,244,103 | 4/1966 | Spickard | 102/202.5 |
| 4,464,989 | 8/1984 | Gibson et al. | 102/202.5 X |
| 4,484,523 | 11/1984 | Smith et al. | 102/202.4 X |
| 4,608,926 | 9/1986 | Stevens | 102/275.4 |
| 4,621,578 | 11/1986 | Vallieres et al. | 102/202.5 X |
| 4,660,472 | 4/1987 | Stevens | 102/275.5 X |
| 4,664,033 | 5/1987 | Burkdoll et al. | 102/275.4 X |

FOREIGN PATENT DOCUMENTS

| | | | |
|---|---|---|---|
| 0030498 | 6/1981 | European Pat. Off. | 102/275.4 |

*Primary Examiner*—David H. Brown
*Attorney, Agent, or Firm*—William J. Beard

[57] ABSTRACT

In an exposed perforating gun assembly, contact with well fluids at high pressure and temperature is detrimental to explosives in the explosive train. This device protects such explosives and includes a cylindrical housing with a bore having an electrical feedthrough at one end, an enclosed initiator, a cooperative sleeve and cooperative sealed retainer. The detonating cord is sealed into proximity with the initiator and is held against high pressure extrusion by the sealed retainer.

9 Claims, 1 Drawing Sheet

THROUGH BULKHEAD EXPLOSIVE INITIATOR FOR OIL WELL USAGE

BACKGROUND OF THE DISCLOSURE

In oil well perforating operations, it has become common practice to use well perforating guns whose explosive components or shaped charges are directly exposed to the well bore fluids. Typically, these explosive components may be carried along a flexible or semi-flexible strip of metallic carrying member and may be locked to the carrying member and affixed through holes bored in that strip, thus directly exposing the shaped charges to the well bore fluid. Rather than flexible strips, another type of disposable or expendable perforating gun may incorporate a plurality of links, similar to the links of a chain, each having a hole bored therein for retaining a shaped charge member held by a retaining ring and pin or screw arrangement.

Guns of these types typically may be referred to as expendable perforating guns in the sense that, when the explosive charges are fired, the carrier of flexible material or linked chain-like material is destroyed or separated into numerous small pieces by the explosion of the shaped charges and may fall to the bottom of the well borehole as small debris. Such expendable carrier perforating guns have the advantage that the maximum sized shaped charge for a given diameter of carrier can be installed as opposed to conventional hollow carrier shaped charge perforating guns. The prior art hollow carrier shaped charge guns of course carry a plurality of longitudinally disposed shaped charges distributed along the length of a hollow mandrel or carrying tube which protects these charges from the borehole fluid environment.

Typically these expendable perforating guns are run on an electrical wireline having either a single or multiple electrical conductors and may be strung together or stacked one above the other to provide several gun sections to increase perforating capability. Such expendable carrier guns have in the past been fired by electrical signals sent down the wireline from the surface which detonate an initiator or explosive cap device which in turn detonates a secondary explosive detonating cord. The detonating cord then initiates the attached shaped charges. After the gun is fired, the wireline is retrieved to the surface of the well while the expendable carrier has been deposited at the bottom of the well bore as small sized debris at which time the well is ready to be produced through the perforations formed by the expendable shaped charge carrier.

The three explosive components that comprise an expendable perforating gun assembly are the detonator or initiator, the detonating cord and the shaped charges themselves. In order for these explosive components to function properly, they must be environmentally protected from well bore fluids, and the downhole pressures exerted by these fluids. Temperature effects on the explosive components may be accounted for by proper selection of thermally stable explosives; in wells up to 18,000 or 20,000 feet in depth, temperatures may reach 400° F. and pressures may reach 18,000 to 20,000 psi. Therefore, the environmental protection provided to the explosive components must protect the components individually, and also the interfaces between the components that form the explosive train.

BRIEF DESCRIPTION OF THE DISCLOSURE

Particular importance is found in the detonator to detonating cord interface and the electric wire line to explosive initiator interface. The present invention provides (1) a hermetically sealed entrance enabling electrical current to flow from the wire line to an electric initiator (referred to here as a "blasting cap" and (2) a fluid tight mechanical assembly for sealing the interface between the detonating cord and a bulkhead separating the secondary explosive booster from the detonating cord. The cord is deployed therefrom to initiate the shaped charge explosives of the expendable gun. The electrical portion of the system features O-ring, hermetically sealed isolation of the electrical blasting cap from the well bore fluid. Similarly a combination metal to metal and elastomeric seal and is used to isolate and seal the junction between detonating cord and a bulkhead separating the secondary explosive booster from the detonating cord.

The above and other features of the present invention will become more apparent when taken in conjunction with the detailed description given below and taken in conjunction with the accompanying drawings in which:

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
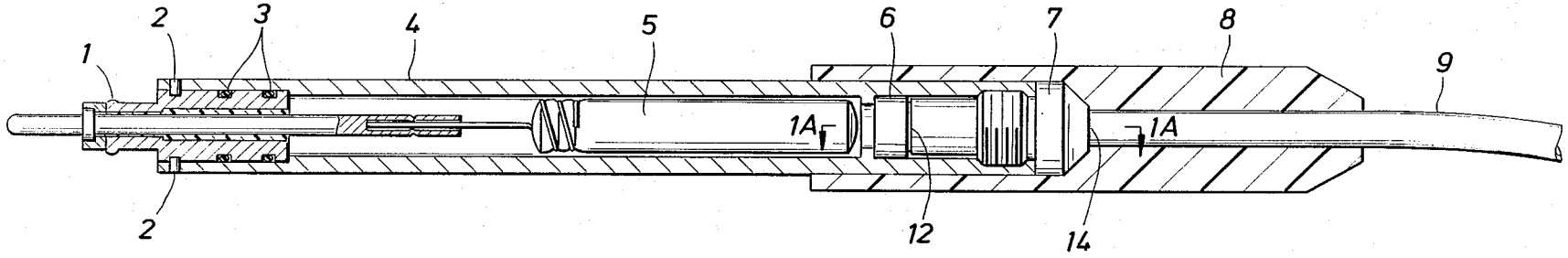
FIG. 1 is a longitudinal sectional view illustrating the through bulkhead explosive initiator according to the concepts of the present invention.

As previously mentioned, of particular importance in the use of expendable well perforating guns for oil and gas well perforating, is the detonator to detonating cord interface and the electrical wire line to initiator interface. At this part of the gun assembly, the explosives must be kept dry and the detonating cord must be restrained from movement due to the hydraulic piston effect of the well bore pressure acting on the cross-sectional area of the exposed detonating cord. This pressure exerted longitudinal force tends to extrude the cord into the initiator housing. Also, the explosive components must be coupled in such a manner that reliable detonating transfer occurs when the electrical blasting cap detonates the secondary explosive and transfers the shock wave due to this explosive booster to the detonating cord itself. Referring now to FIG. 1, a through bulkhead explosive initiator according to concepts of the present invention is illustrated schematically in longitudinal partial section view. The initiator comprises a pressure resistant housing 4 which is hermetically sealed at the upper end with an electrical feedthrough connector 1. A set of retaining pins 2 retains the feedthrough while the elastomeric O-rings 3 prevent fluid leakage into the housing 4. An explosive device 5 is attached to the electrical feedthrough 1. This device 5 may be a conventional type hot wire detonator (commonly called a blasting cap), an exploding bridgewire detonator or an exploding foil detonator. It could even by a laser initiated device if the electrical feedthrough connector 1 incorporates a fiber optic feedthrough for transmitting laser light. Regardless of the explosive device actually housed within the housing 4, the aforementioned assembly comprises a significant portion of the through bulkhead initiator of the present invention.

Figure 1A:
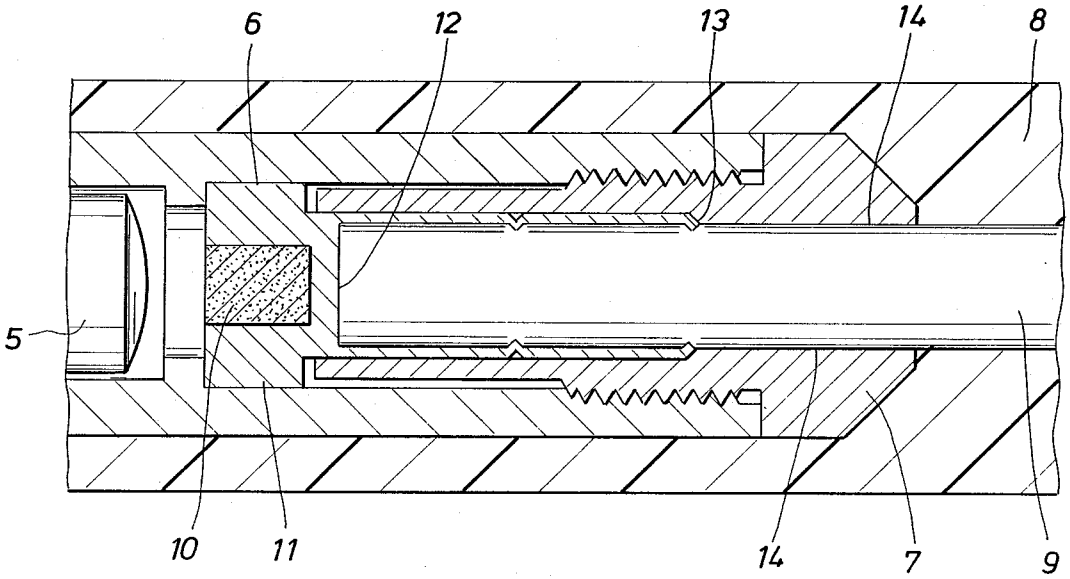
FIG. 1A is an enlarged detail of the longitudinal sectional view showing the bulkhead and secondary explosive of the initiator of the present invention.

A cooperative portion of the initiator comprises a crimp sleeve 6 that contains a pressed pellet of secondary explosive 10 in its upper end. This is sometimes referred to as a booster load. The lower end of the crimp sleeve 6 is designed to slide over the detonating cord 9 and is retained thereto by crimping onto the detonating cord with suitable hand crimps in a manner well known in the art. The crimp sleeve 6 and the attached detonating cord 9 slip inside the housing 4 and abut the shoulder 11. A bulkhead 12 shown in more detail in FIG. 1A is an integral part of the crimp sleeve 6. This bulkhead 12 prevents the detonating cord 9 from extruding forward due to the piston effect of well bore fluid pressure acting on the cross-sectional area of the detonating cord and forcing it upwardly in the housing 4. For typical cross-sectional areas of detonating cord, this force can be as much as 700 pounds in a 20,000 psi well bore.

A retainer 7 is threaded into the end of the housing 4 so that it retains the crimp sleeve 6 against the shoulder 11. A metal to metal seal is formed at the interface 13 between the crimp sleeve 6 and the retainer 7. This prevents the detonating cord 9 extruding through any gaps into the interior of the initiator housing 4. The pressured detonating cord also expands radially very slightly and closes the clearance gap 14 between the retainer 7 and the cord 9. This expansion allows an elastomeric boot 8 to form a high pressure seal at the lower end of the initiator. Extrusion of the boot 8 into the initiator is not possible since the clearance gap 14 has now been closed due to the aforementioned radial expansion of the pressured detonating cord.

In operation the explosive device 5 is initiated by an electrical or optical firing signal sent from the surface equipment to the downhole expandable perforating gun. The resulting shock wave travels across a short air gap and detonates the secondary explosive booster 10 in the crimp sleeve 6. The shock wave resulting from the detonation of explosive 10 in the crimp sleve 6 travels through the bulkhead 12 and in turn initiates the detonating cord 9. Initiation of the detonating cord 9 in turn sets off or detonates the shaped charge explosives carried by the expendable perforating gun carrier to perforate the well borehole in which the device is used.

The foregoing descriptions may make other alternative arrangements according to the concepts of the present invention apparent to those skilled in the art. It is the aim of the appended claims to cover all such changes and modifications as fall within the true spirit and scope of the invention.

We claim:

1. An explosive initiator for well borehole use in high temperature and pressure wells where explosive train components come into direct contact with well borehole fluid, comprising:

(a) a generally elongated cylindrically shaped housing member having a bore therethrough, and having an upper end and a lower end, said bore having a shoulder in the lower end of said housing member;

(b) an electrical conductor feedthrough connector entering said bore at said upper end of said housing member cooperative with a hermetic seal therebetween;

(c) an explosive initiator in said bore above said shoulder and electrically coupled to said electrical conductor feedthrough;

(d) sleeve means, being generally cylindrically shaped and having a bulkhead at the upper end thereof, said bulkhead on its upper surface being provided with a recessed portion for receiving a pressed pellet of secondary explosive sized therefor, said secondary explosive pellet functioning as a booster load for propagating a shock wave initiated by said explosive initiator across said bulkhead and into the portion of said sleeve means below said bulkhead, thereby enhancing the propagation of the detonation initiated by said explosive initiator into the portion of said sleeve means below said bulkhead, said sleeve means being sized to enter said housing member from its lower end and to abut said shoulder from below, and said sleeve means being sized for receiving a length of detonating cord at its lower end and being adapted for affixation thereto;

(e) retaining means for fixedly retaining said sleeve means in said bore of said housing member; and (f) means for fluid tight sealing said retaining means to said housing member at its lower end, such that said housing member is sealingly connected to said electrical conductor feedthrough at one end thereof and said detonating cord at the opposite end thereof.

2. The apparatus of claim 1 wherein said bulkhead is shaped in such manner on its lower surface to prevent extrusion of said detonating cord into the interior of the device.

3. The apparatus of claim 1 wherein said explosive initiator in said housing bore comprises a hot wire detonator.

4. The apparatus of claim 1 wherein said explosive initiator in said housing bore comprises an exploding bridgewire detonator.

5. The apparatus of claim 1 wherein said explosive initiator in said housing bore comprises an exploding foil initiator.

6. The apparatus of claim 1 wherein said sleeve means is adapted for affixation to said detonating cord by incorporating crimping means.

7. The apparatus of claim 1 wherein said electrical conductor feedthrough connector is hermetically sealed to said housing member by use of a plurality of elastomeric O-rings.

8. The apparatus of claim 1 wherein said means for fluid tight sealing and retaining means to said housing member comprises an elastomeric boot.

9. The apparatus of claim 8 wherein said sealing means further includes the use of radially expansive detonating cord which, under pressure, expands to close any radial gap between said detonating cord and said bore.

* * * * *